US007661405B2

(12) United States Patent
Matsuura et al.

(10) Patent No.: US 7,661,405 B2
(45) Date of Patent: Feb. 16, 2010

(54) THROTTLE VALVE DEVICE FOR AN INTERNAL COMBUSTION ENGINE

(75) Inventors: Yasushi Matsuura, Wako (JP); Tetsuji Furukawa, Wako (JP); Masanobu Tsurumi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 12/196,017

(22) Filed: Aug. 21, 2008

(65) Prior Publication Data

US 2009/0056671 A1 Mar. 5, 2009

(30) Foreign Application Priority Data

Aug. 29, 2007 (JP) ..... 2007-222008

(51) Int. Cl.
*F02D 9/08* (2006.01)

(52) U.S. Cl. ..... 123/337; 137/171; 251/305

(58) Field of Classification Search ..... 123/337; 251/304, 305; 137/171, 546
See application file for complete search history.

(56) References Cited

U.S. PATENT DOCUMENTS

| | | | | |
|---|---|---|---|---|
| 5,704,335 | A * | 1/1998 | Akutagawa et al. | 123/337 |
| 7,117,845 | B2 * | 10/2006 | Iwaoka et al. | 123/337 |
| 7,237,759 | B2 * | 7/2007 | Andoh et al. | 251/208 |
| 2002/0084436 | A1 * | 7/2002 | Rauch et al. | 251/305 |
| 2004/0040536 | A1 * | 3/2004 | Suzuki | 123/337 |
| 2004/0119041 | A1 * | 6/2004 | Kawai et al. | 251/305 |
| 2004/0129248 | A1 * | 7/2004 | Kawai | 123/337 |
| 2005/0000488 | A1 * | 1/2005 | Shibata et al. | 123/337 |
| 2008/0029073 | A1 * | 2/2008 | Klipfel et al. | 123/568.11 |

FOREIGN PATENT DOCUMENTS

| | | | |
|---|---|---|---|
| DE | 19628059 | A1 | 1/1997 |
| EP | 1109792 | A1 | 5/1984 |
| EP | 1126146 | A2 | 8/2001 |
| EP | 1348850 | A1 | 10/2003 |
| JP | 9-49443 | | 2/1997 |
| JP | 2002-206434 | | 7/2002 |

* cited by examiner

*Primary Examiner*—Stephen K Cronin
*Assistant Examiner*—Anthony L Bacon
(74) *Attorney, Agent, or Firm*—Lahive & Cockfield, LLP; Anthony A. Laurentano, Esq.

(57) ABSTRACT

Provided is a throttle valve device for an internal combustion engine which is favorably protected from icing, and enables a favorable control of the intake flow rate by avoiding an abrupt increase in the flow rate particularly in a small opening angle range. An upstream recess (21) and a downstream recess (22) are formed in a lower part of the throttle bore (11) of the throttle valve device. Moisture that may deposit on the inner wall of the throttle bore is allowed to be drained to the recesses. A cross sectional area of one of the recesses over which the lower edge of the throttle valve member sweeps as the throttle valve member (30) opens from the fully closed position is smaller than that of the other recess so that an abrupt change in the intake flow rate can be avoided in a small opening angle region.

14 Claims, 7 Drawing Sheets

THROTTLE VALVE DEVICE FOR AN INTERNAL COMBUSTION ENGINE

TECHNICAL FIELD

The present invention relates to a throttle valve device for an internal combustion engine, and in particular to a technology for preventing icing or freezing of a throttle valve device which is disposed laterally.

BACKGROUND OF THE INVENTION

In a throttle valve device provided in an intake system of an internal combustion engine, icing or deposition of ice on an inner wall of a throttle bore owing to the freezing of moisture that condenses in the throttle bore is required to be avoided so that the throttle valve member may be allowed to be opened and closed without fail. For this purpose, it was proposed to provide a concentric annular ridge around the entire circumference of the throttle bore and install a heater buried within the annular ridge over the entire circumference thereof (see Japanese patent laid open publication No. 2002-206434).

In such a throttle valve device which is disposed in a lateral orientation with the throttle bore extending in the horizontal direction, because the inner wall of the throttle bore adjoining the peripheral edge of the throttle valve member is elevated with respect to the adjoining parts, accumulation or deposition of moisture between the peripheral edge of the throttle valve member at its fully closed position and the inner wall of the throttle bore can be avoided. Moreover, under an operating condition where freezing of moisture could occur, the heater is energized so that ice deposition that may exist can be melted, and any freezing or seizing between the outer peripheral part of the throttle valve and the ridge can be avoided. In particular, because the ridge is given with a small width, the dissipation of heat from the heater to the surrounding part of the throttle body by conduction can be minimized, and the consumption of electric power for deicing the throttle valve device can be minimized.

However, in such a conventional throttle valve device, because the ridge extends over the entire circumference of the inner wall of the throttle bore adjoining the outer edge of the throttle valve member at its fully closed position, and the width of the ridge is relatively small, the effective cross sectional area of the throttle bore abruptly increases when the throttle valve member has turned by a small angle from its fully closed position. Therefore, the air flow that is metered by the throttle valve member or the intake flow rate abruptly increases as the throttle valve member opens from the fully closed position, and this makes the intake flow rate control highly difficult.

Also, in the conventional arrangement, the heater extends over the entire circumference of the throttle bore, and heats the entire circumference of the throttle bore including the upper part thereof and parts adjoining the valve shaft. Therefore, the heater is employed to heat not only the necessary part but also unnecessary parts, and this causes a significant part of the heating energy to be wasted.

BRIEF SUMMARY OF THE INVENTION

In view of such problems of the prior art and a recognition by the inventors, a primary object of the present invention is to provide a throttle valve device for an internal combustion engine which is favorably protected from icing.

A second object of the present invention is to provide a throttle valve device which enables a favorable control of the intake flow rate by avoiding an abrupt increase in the flow rate particularly in a small opening angle range.

A third object of the present invention is to provide a throttle valve device which is fitted with a heater for preventing icing at a minimum consumption of energy.

According to the present invention, these and other objects can be accomplished by providing a throttle valve device for an internal combustion engine, comprising: a throttle valve body defining a throttle bore extending substantially in a horizontal direction; a throttle valve member comprising a butterfly valve rotatably supported by the throttle valve body for selectively opening and closing the throttle bore at an axially intermediate point of the throttle bore, the throttle valve having a default position defined by a small opening angle with respect to a fully closed position thereof; an upstream recess extending laterally at least in a lower part of the throttle bore and axially from a point adjacent to a lower edge of the throttle valve member at the default position by a prescribed distance in an upstream direction; and a downstream recess extending laterally at least in a lower part of the throttle bore and axially from a point adjacent to the lower edge of the throttle valve member at the default position by a prescribed distance in a downstream direction; a cross sectional area of one of the recesses over which the lower edge of the throttle valve member sweeps as the throttle valve member opens from the fully closed position being smaller than that of the other recess.

The provision of the recesses allows any moisture that may be deposited on an inner wall surface of the throttle bore is favorably guided down to the recesses under the gravitational force and this prevents the freezing of the throttle valve member at its fully closed position or default position. Because the cross sectional area of one of the recesses over which the lower edge of the throttle valve member sweeps as the throttle valve member opens from the fully closed position is smaller than that of the other recess, any abrupt change in the flow rate can be avoided particularly in a small opening angle range, and a linear valve opening property can be achieved without requiring any complex arrangement.

In a typical embodiment of the present invention, the throttle valve member is configured such that the lower edge of the throttle valve member moves in an upstream direction as the throttle valve member opens from the fully closed position, and the cross sectional area of the upstream recess is smaller than that of the downstream recess. However, it is also possible to configure the throttle valve member such that the lower edge of the throttle valve member moves in a downstream direction as the throttle valve member opens from the fully closed position, and the cross sectional area of the downstream recess is smaller than that of the upstream recess.

In any case, a ridge is defined between inner ends of the upstream and downstream recesses, the ridge having an upper surface defining a cylindrical throttle bore inner wall jointly with a remaining part of the cylinder bore. If a heater incorporated in the ridge, because the ridge is given with a relatively narrow width and has a limited length, the energy consumption can be minimized while the most essential part is heated so that icing of the throttle valve device can be effectively prevented. Because plastic material has a relatively low thermal conductivity, and a lower wettability with respect to moisture, icing can be particularly favorably avoided if the throttle body is essentially made of plastic material.

If an axially inner end of the downstream recess is located adjacent to the lower edge of the throttle valve member at the fully closed position thereof, icing can be particularly favorably prevented. The downstream part of the throttle valve member is exposed to EGR gas or blow by gas which is known to have a high moisture content. Therefore, by reducing the surface area on which an ice deposition may form, any accumulation of ice deposition that may hinder the opening movement of the throttle valve member can be minimized.

It is particularly desirable that the lower edge of the throttle valve member does not sweep over any deep recess as it moves over a small opening angle from the fully closed position in view of avoiding any abrupt change in the intake flow rate particularly in a small opening angle range. For this purpose, it is desirable if a surface area of a part of the upper surface of the ridge located downstream of the lower edge of the throttle member at the default position thereof is smaller than a surface area of a part of the upper surface of the ridge located upstream of the lower edge of the throttle member at the default position thereof. Additionally or alternatively, a distance between the lower edge of the throttle member at the default position thereof and the inner end of the downstream recess may be shorter than a distance between the lower edge of the throttle member at the default position thereof and the inner end of the upstream recess.

According to a preferred embodiment of the present invention, each recess is provided only in a lower part of the throttle bore. Thereby, the generally cylindrical shape of the throttle bore can be maintained over a large part thereof so that the influence of the presence of the recesses on the intake flow rate control property of the throttle valve device can be minimized. For the same reason, each recess may be defined by a bottom surface which is concentric to a remaining part of the throttle bore.

According to a particularly preferred embodiment of the present invention, a downstream end of the throttle body is provided with a flange for connecting the throttle valve device to another intake member, and the downstream recess is formed in the flange. Therefore, even when a relatively deep recess is formed in the downstream part of the throttle bore, the thickness of the wall surrounding the throttle bore can be maintained at an adequate level over the entire circumference thereof without adding any excessive material.

Also, the flange may be provided with three mounting points including a top mounting point and a pair of lower mounting points arranged in a line symmetric arrangement with respect to a line passing through the top mounting point, and the downstream recess is formed only between the lower two mounting points. Each mounting point may be in the form of a mount hole through which a mounting bolt is to be passed, or a stud bolt which may be used in a similar fashion as a mounting bolt. In such case, the lower two mounting points may be closer to each other than to the top mounting point so that the fasteners that are used for the respective mounting points can ensure an adequate seal pressure at the mating surface of the flange even when a lower part of the wall surrounding the throttle bore has a relatively small thickness and is therefore relatively less rigid.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
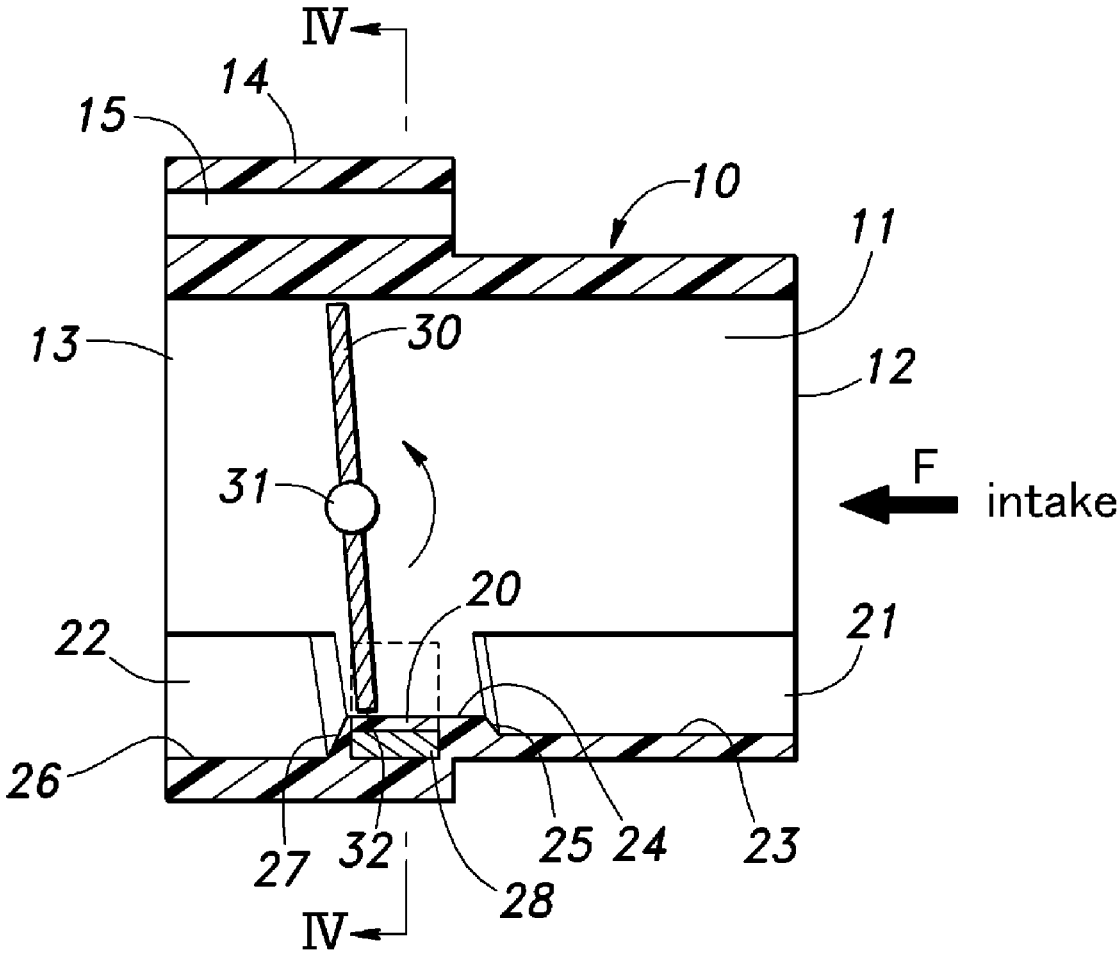
FIG. 1 is a vertical sectional view of a throttle valve device for an internal combustion engine embodying the present invention.

A throttle valve embodying the present invention is described in the following with reference to FIGS. 1 to 6. This throttle valve comprises a throttle body 10 defining a throttle bore 11 therein communicating with an intake passage of an engine not shown in the drawings and a throttle valve member 30 comprising a butterfly valve member rotatably supported in an axially middle part of the throttle bore 11 by a valve shaft 31 for selectively opening and closing the throttle bore 11.

The throttle body 10 may be generally made of plastic material such as reinforced plastic material combining glass fibers, organic fillers and other reinforcing media with various plastic materials such as PPS (polyphenylene sulfide). The throttle body 10 is typically placed in the lateral arrangement shown in FIG. 1 with the throttle bore 11 extending horizontally owing to the requirements of the engine layout in a vehicle. In the illustrated embodiment, the throttle bore 11 has a circular cross section and extends horizontally through the throttle body 10, and has an inlet 12 or an upstream end communicating with an air cleaner not shown in the drawing (on the right hand side of FIG. 1) and an outlet 13 communicating with an intake manifold not shown in the drawings) (on the left hand side of FIG. 1).

The part of the throttle body 10 surrounding the inlet 12 is radially extended so as to form a radial flange 14 (or a thick walled portion) for connecting the throttle body 10 to an intake manifold or an intake surge tank. The flange 14 is formed with three axial holes 15 for receiving mounting bolts not shown in the drawings. The part of the throttle body 10 surrounding the outlet 12 is simply tubular in shape, devoid of any such flange, so that an intake tube made of plastic material and communicating with the air cleaner may be fitted directly thereon.

The throttle valve member 30 and valve shaft 31 are made of metallic material in this embodiment, but may also be made of plastic material. The throttle valve member 30 is given with a circular shape so as to conform to the cross sectional shape of the throttle bore 11. Although not shown in the drawings, the valve shaft 31 is connected to an electric motor via a reduction gear mechanism so that the throttle valve member 30 may be actuated by the electric motor. In other words, the throttle valve of the illustrated embodiment is adapted for a drive by wire system.

Figure 5:
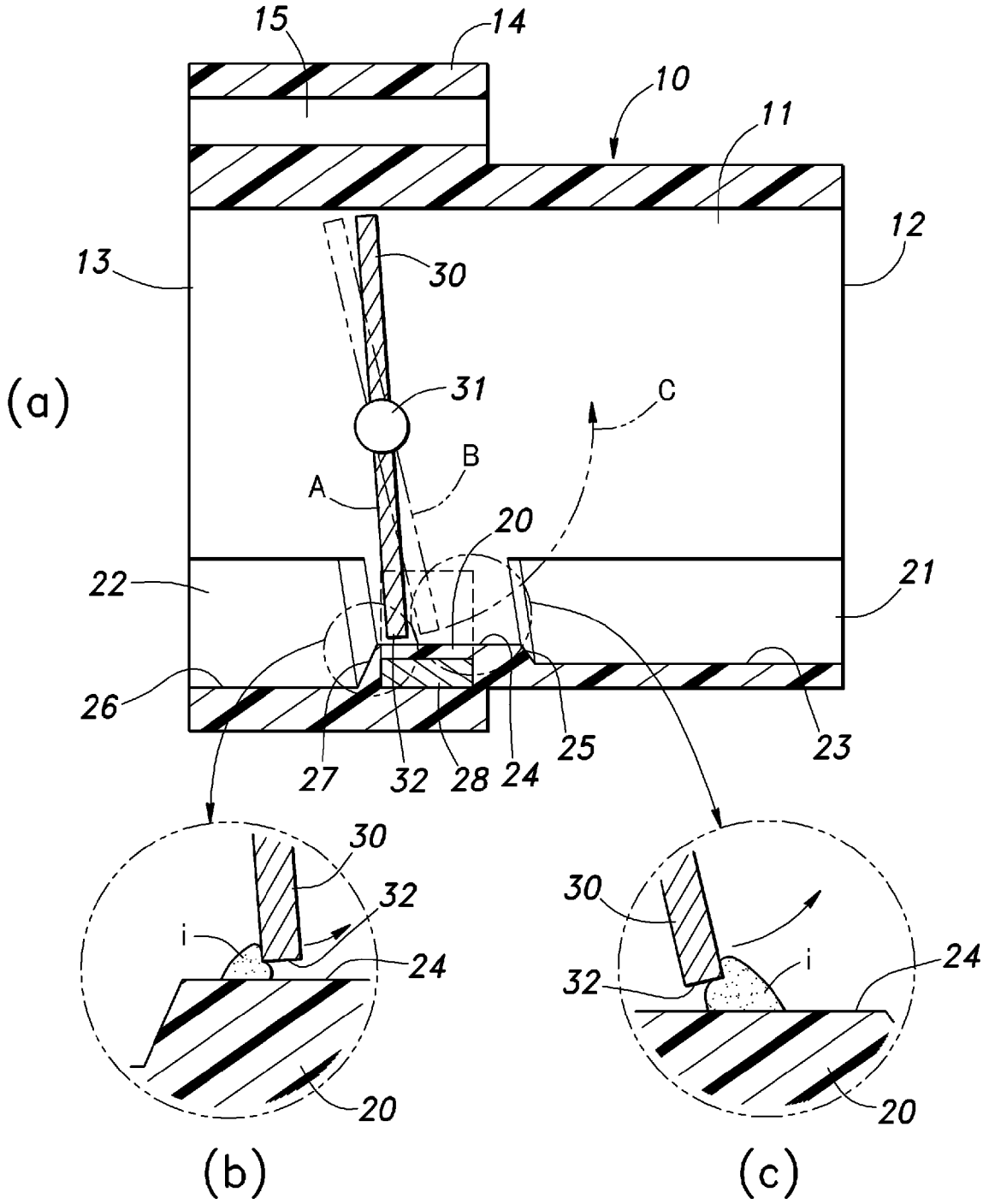
FIG. 5 is a view similar to FIG. 1 illustrating the mode of operation of the embodiment and how icing could occur.
Figure 6:
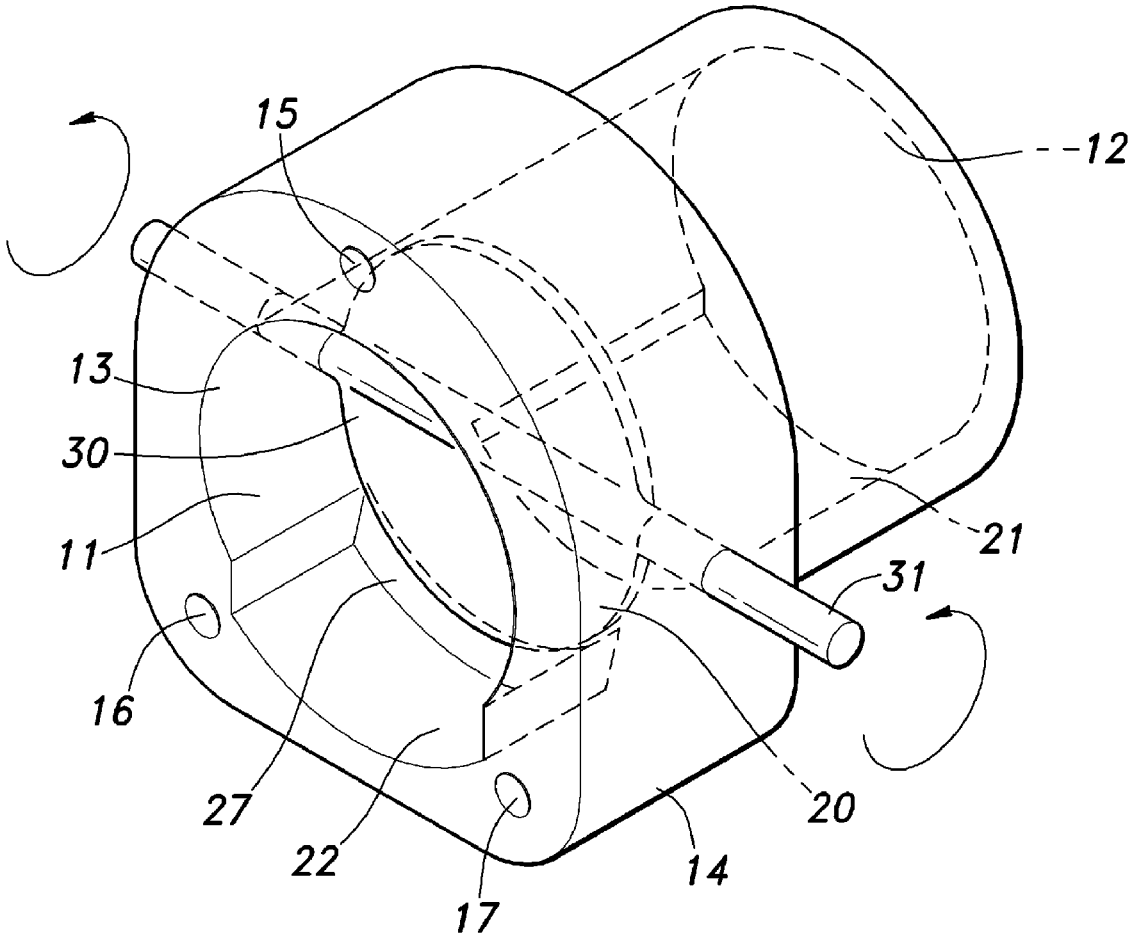
FIG. 6 is a simplified perspective view of the throttle valve device.

Referring to FIG. 1, the valve opening increases as the throttle valve 30 is turned in counter clockwise direction around the valve shaft 31. In FIG. 5, the solid lines A denote the fully closed position of the valve member 30, and the imaginary lines B denote a default position of the valve member 30 which is taken when the engine is stopped (or in an de-energized state of the throttle valve). In the illustrated embodiment, the valve member 30 is slightly tilted in counter clockwise direction from the vertical position (perpendicular to the axial line of the intake bore 11) even in the fully closed position thereof, and the default position is characterized by a small opening angle of the throttle valve member 30 with respect to the fully closed position thereof.

Figure 2:
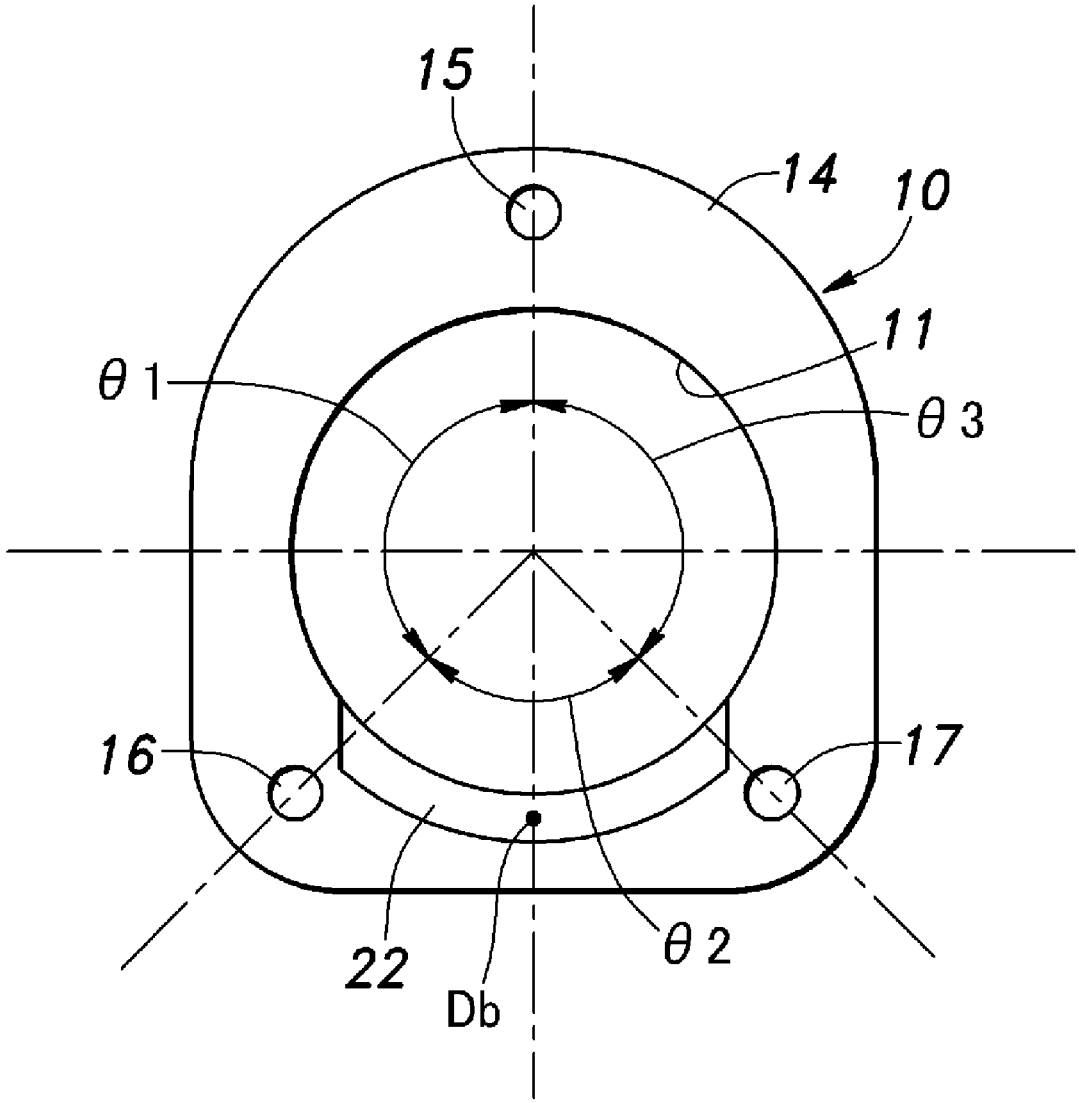
FIG. 2 is a left end view of the throttle valve device illustrated in FIG. 1.
Figure 3:
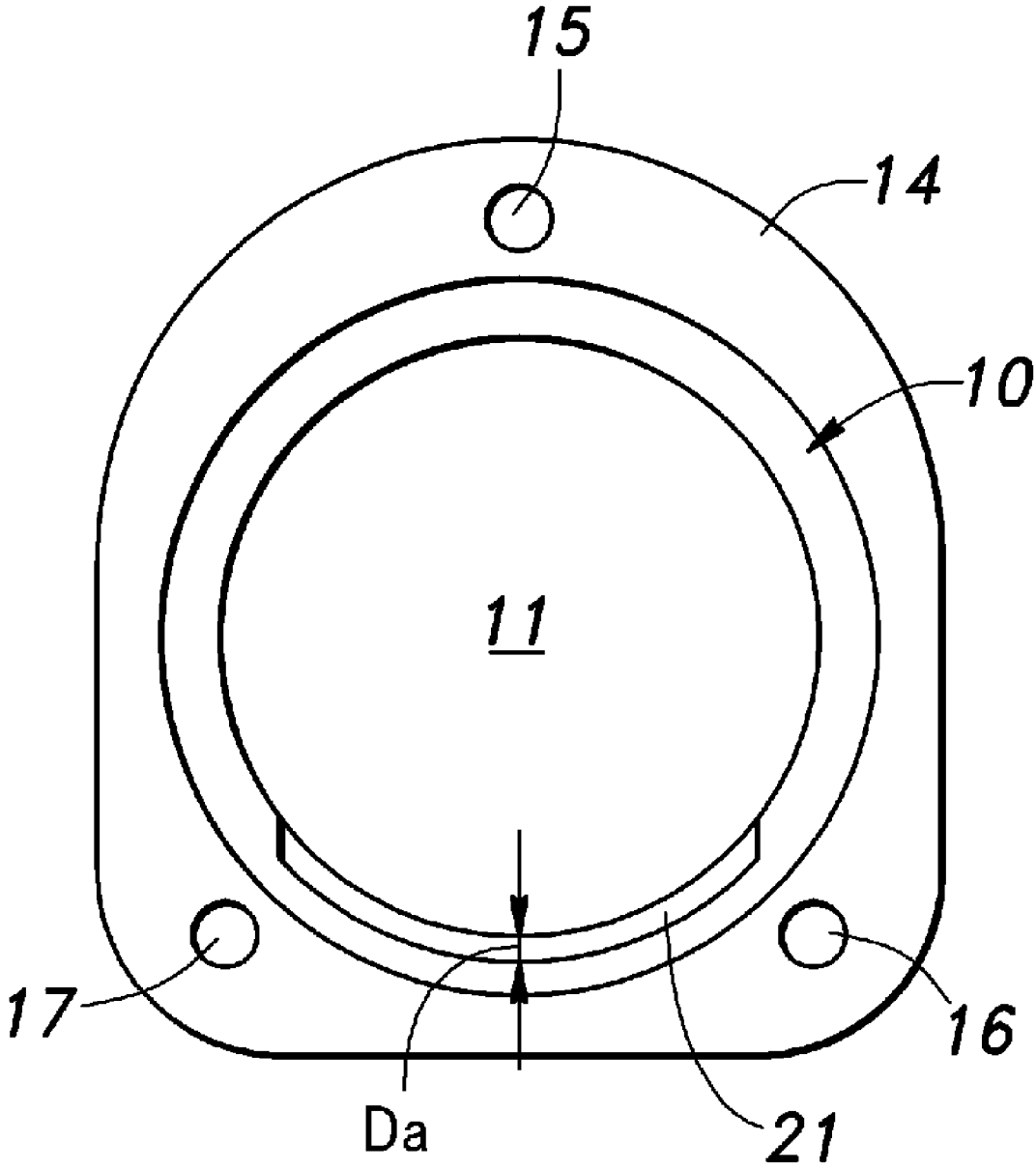
FIG. 3 is a right end view of the throttle valve device illustrated in FIG. 1.
Figure 4:
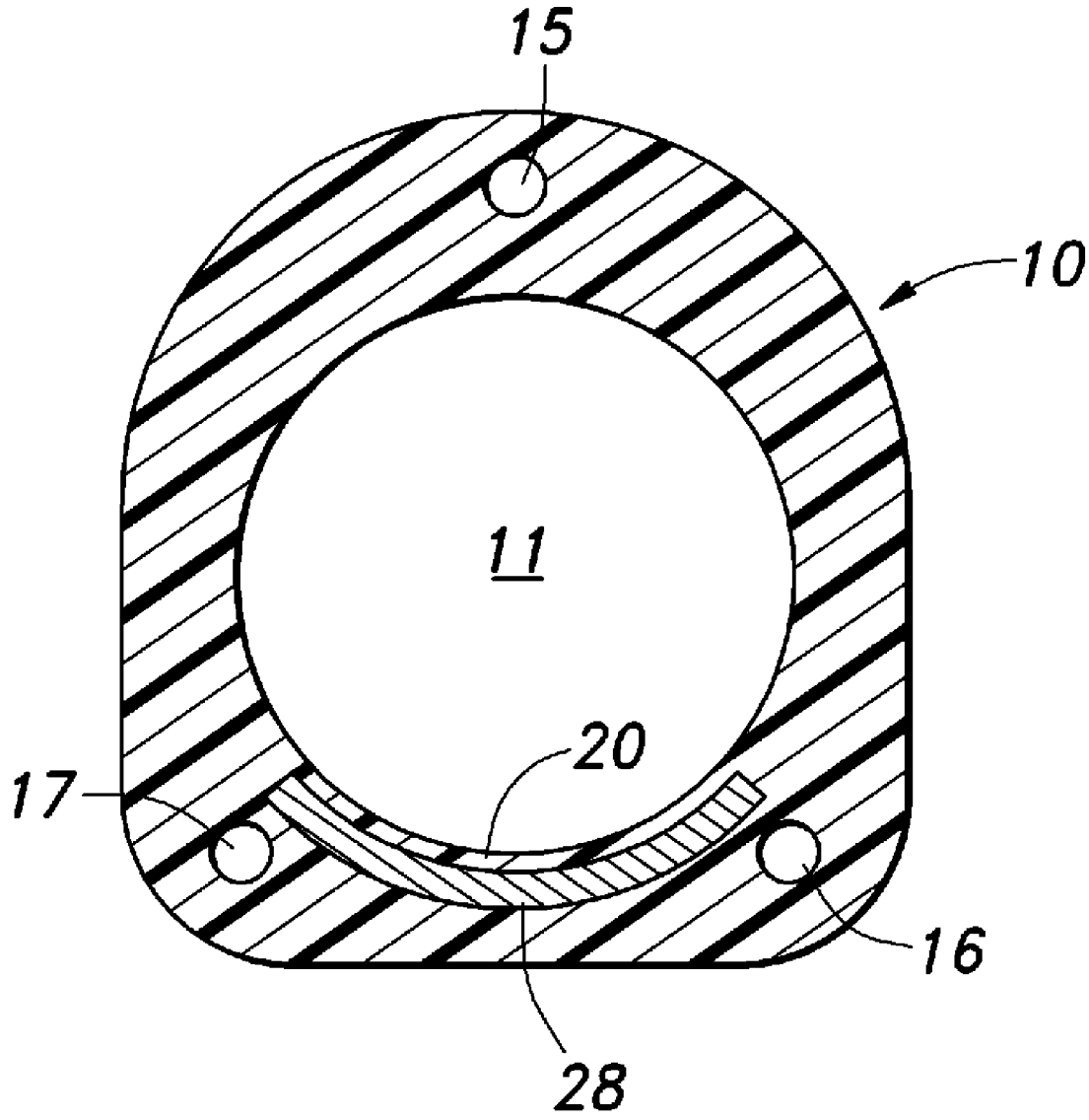
FIG. 4 is a sectional view taken along line IV-IV of FIG. 1.

The part of the inner wall of the throttle bore 11 opposing the outer edge 32 of the throttle valve member 30 is called as a reference cross section 20 of the throttle bore 11. The throttle bore 11 at this reference cross section 20 is circular. However, the cross section of the throttle bore 11 is enlarged in a bottom part thereof in both the upstream and downstream parts thereof with respect to the reference cross section 20. The bottom part of the downstream section of the intake bore (with respect to the reference cross section 20) is formed with a downstream recess 22 which can be formed by locally increasing the diameter of the intake bore 11 over an angle of about 90 degrees (θ2) as shown in FIG. 2. In other words, the bottom of the downstream recess 22 is defined by a part of a circle concentric to the cross section of the intake bore 11 at the reference cross section. The recess 22 is symmetric with respect to the vertical center line of the throttle bore 11, and side ends (as seen in FIG. 2) are defined by vertical walls. The bottom part of the upstream section of the throttle bore 11 is similarly formed with an upstream recess 21 which is similar to the downstream recess 22 but is slightly shallower. The region of the reference cross section 20 has a certain axial length, and these recesses 21 and 22 extend from the region of the reference cross section 20 to the inlet 12 and outlet 13 of the throttle bore, respectively.

The upstream recess 21 in the upstream section is adjacent to the lower edge of the throttle member 30 as it moves in the opening direction from the fully closed position (counter clockwise rotation of the throttle valve member 30). In other words, the lower edge of the throttle valve member sweeps over the upstream recess 21 as the throttle valve member 30 opens from the fully closed position. The cross sectional area of the upstream recess 21 is smaller than that of the downstream recess 22. The size of the cross sectional area of each recess is determined by the depth and width (angular range). In the illustrated embodiment, the depth Da of the upstream recess 21 is smaller that the depth Db of the downstream recess 22 while the widths of the two recesses 21 and 22 are equal to each other so that the cross sectional area of the upstream recess 21 is smaller than that of the downstream recess 22. Conveniently, the wall thickness of the downstream end of the throttle bore 11 is greater than that of the upstream end thereof owing to the provision of the flange 14, and the downstream recess 22 is provided in a space between the two mounting holes 16 and 17 so that the recess 22 does not create any excessively thin walled part in the throttle bore 11.

As shown in FIG. 1, the wall surface 24 of the reference cross section 20 is connected to the bottom surface 23 of the upstream recess 21 via a slope (moisture guide surface) 25. Similarly, the wall surface 24 of the reference cross section 20 is connected to the bottom surface 26 of the downstream recess 22 via a slope (moisture guide surface) 27. In the illustrated embodiment, the inner end of the downstream recess 22 or the slope 27 immediately adjoins the lower edge of the throttle valve member 30 at its fully closed position from the downstream side thereof.

In the wall of the throttle bore 11 defining a lower part of the region of the reference cross section 20 is internally incorporated a heater 28 in a sheet form which may consist of a resistive wire heater, ceramic heater, PTC heater or the like. The heater 28 is curved so as to conform to the curved shape of the bottom wall of the throttle bore 11. In other words, the heater 28 extends concentrically to the central axial line of the throttle bore 11 over an angular range of about 90 degrees. The angular extent of the heater 28 may be similar to those of the recesses 21 and 22.

The throttle body 10 is preferably made of heat resistant plastic material that can safely withstand the heat generated by the heater 28. In the illustrated embodiment, the throttle body 10 is made of reinforced plastic material mainly consisting of PPS having a required heat resistance.

Moisture (water) that may condense in the throttle bore 11 flows downward along the inner wall of the throttle bore 11 under the gravitational force. Most of the moisture eventually reaches the upstream recess 21 and downstream recess 22 and is collected therein. Most part of the moisture that may be produced on the wall surface 24 of the reference cross section 20 may initially flows down to the bottom part of the wall surface 24, but then flows to both the upstream recess 21 and downstream recess 22 via the corresponding slopes 25 and 27, respectively. Therefore, very little moisture, if any, can remain on the wall surface of the reference cross section 20. This is beneficial in a cold weather because the absence of moisture in this area means a reduce possibility of icing or freezing of moisture in this area.

As shown in parts (b) and (c) of FIG. 5, even when an ice deposition i is formed in the gap between the wall surface 24 of the reference cross section 20 and the outer edge 32 of the throttle valve member 30 at its default position, it does not grow to any significant size so that the ice deposition i can be easily broken and the throttle valve member 30 can be safely opened under the actuating force of the electric motor.

Moisture condensation tends to occur immediately downstream of the throttle valve at its fully closed position because of a high moisture content of the blow-by gas or EGR gas that is likely to be present in this area. In the illustrated embodiment, because the slope 27 is located immediately downstream of the throttle valve member 30 at its fully closed position, as shown in part (b) of FIG. 5, a small ice deposition i that may be formed in this area has a limited surface area so that it can be easily broken by the actuating force for opening the throttle valve member 30. Therefore, the freezing of the throttle valve member 30 at its default position can be avoided.

Also, the throttle body 10 made of plastic material has a lower heat conductivity and a lower wettability than one made of metallic material, and these factors also contribute to the reduced possibility of freezing. Freezing of the throttle valve member 30 at its default position can be more effectively avoided by energizing the heater 28 to heat the wall surface of the reference cross section 20, and thereby melting the ice deposition i with heat.

Because the upstream recess 21 and downstream recess 22 are formed only in the lower part of the throttle bore 11, the wall surface 24 of the reference cross section 20 in effect forms a locally elevated part only so far as the bottom part of the throttle bore 11 is concerned where moisture deposition could cause a problem. As opposed to forming an elevated part or ridge line feature over the entire circumference of the throttle bore 11, the function of the throttle valve member 30 particularly in a small opening angle region is not substantially affected by the features formed on the inner wall of the throttle bore 11.

Also, because the cross sectional area of the upstream recess 21 to which the lower edge of the throttle valve member 30 approaches as it opens is substantially smaller than that of the downstream recess 22, the influence of the upstream recess 21 on the function of the throttle valve member in a small opening angle region can be minimized, and any abrupt change in the intake flow rate can be avoided.

The fact that the downstream recess 22 has a larger cross sectional area than the upstream recess 21 is advantageous because the downstream part of the throttle valve member 30 tends to experience a higher rate of moisture condensation from EGR gas and blow by gas, and the downstream recess 21 is given with a greater capacity for accommodating the condensed moisture.

In the illustrated embodiment, the upstream recess 22 is more spaced from the throttle valve member 30 in the fully closed position than the downstream recess 21. The lower edge of the throttle valve member 30 sweeps a trajectory as denoted with letter C in FIG. 5, and comes adjacent to the slope 25 and upstream recess 21 only when the throttle valve member 30 is opened at least to a medium opening angle position, which is well beyond the low or idle opening angle range. Therefore, the presence of the slope 25 and upstream recess 21 does not substantially affect the function of the throttle valve member in a small opening angle range, and the throttle valve member 30 is enabled to demonstrate a relatively linear flow control property.

Thus, the illustrated embodiment allows an accurate control of the intake air flow under an idle condition without complicating the structure. Because the heater 28 is provided in a lower part of the reference cross section 20 of the throttle valve 11 where an ice deposition is most likely to occur, the required heat consumption is minimized, and this contributes to the reduction in cost, weight and power consumption.

Also, because the relatively deep downstream recess 22 and heater 28 are formed in the flange 14 of the throttle body 10 having a relatively large wall thickness, the required rigidity of the throttle body 10 can be attained without increasing the size or weight of the throttle body 10.

The downstream recess 22 and heater 28 are located between the two mounting bolts passed through the mounting holes 16 and 17. The angle θ2 between the two mounting holes 16 and 17 is smaller than the angle θ1 between the mounting holes 15 and 17 or that θ3 between the mounting holes 15 and 16 as shown in FIG. 2. The downstream recess 22 reduces the wall thickness of the throttle body 10. However, because the thin walled portion is located between the mounting holes that define a relatively small angle, an adequate and uniform seal pressure can be achieved on the mating face of the flange 14 which typically abuts a corresponding intake manifold or a surge tank. Also, the size of the region where the heater 28 is required can be minimized.

The primary advantages of the illustrated embodiment are summarized in the following:

(1) Because each recess or expanded part of the throttle bore is located in a lower part of the inner wall of the throttle bore opposing the default position of the throttle valve member 30, the moisture that may condense around the throttle valve member when the engine is stopped is allowed to flow down to the expanded part, and is therefore prevented from being deposited on the wall surface of the throttle valve member immediately surrounding the throttle valve member. Although the expanded part or recess is provided only in a lower part of the throttle bore where icing is mostly likely to occur, the retention of moisture in a part adjoining the throttle valve member at the default position can be minimized.

(2) Because the throttle bore cross sectional area in one of the expanded portions (upstream recess 21) opposing the lower edge of the throttle valve member 30 as it turns in the opening direction from the default position is smaller than that of the other expanded portion (downstream recess 22), an abrupt change in the intake flow rate can be avoided when opening the throttle valve member 30.

(3) The part of the throttle bore 11 immediately downstream of the throttle valve member 30 is prone to water condensation owing to the presence of blow by gas or EGR gas in this area. By making the expanded portion (downstream recess 22) of the downstream part where moisture deposition is likely to occur larger than that of the upstream part (upstream recess 21), the retention of moisture in the part adjacent to the throttle valve member at its default position can be minimized.

(4) Because the downstream recess 22 is immediately downstream and opposite to the lower edge of the throttle vale member 30 at its fully closed position, the retention of moisture near the default position of the throttle valve member 30 can be minimized.

(5) The provision of the heater 28 positively prevents freezing of the throttle valve. Furthermore, the heater 28 is not required to be provided on the entire circumference of the throttle bore but only in the lower part of the throttle bore where moisture tends to gather and ice deposition is likely to occur so that the power consumption, cost and weight can be minimized.

(6) The throttle body 10 made of plastic material has a lower thermal conductivity and reduced wettability than one made of metallic material so that an advantage can be gained in preventing the freezing of the throttle valve by an appropriate selection of the material for the throttle body.

The throttle device of the present invention is not limited by the foregoing embodiment. For instance, the throttle valve member 30 may turn in clockwise direction to open the throttle bore with the intake side located on the right hand side of the drawing as illustrated in FIG. 7.

Figure 7:
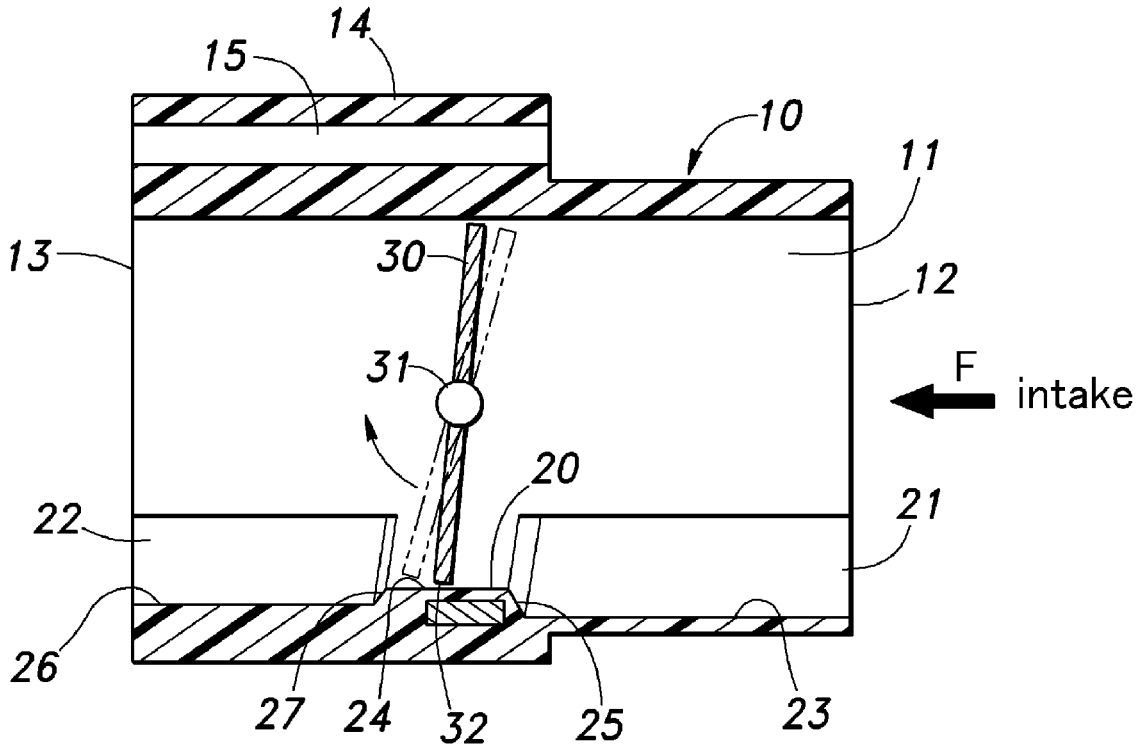
FIG. 7 is a modified embodiment of the present invention.

In this case, the lower edge of the throttle valve member 30 as it opens from the fully closed position turns in clockwise direction as seen in FIG. 7 and sweeps over and above the downstream recess 22. The cross sectional area of the downstream recess 22 is smaller than that of the upstream recess 21. This embodiment also prevents an abrupt change in the intake flow rate as the throttle valve member 30 is opened.

The heater 28 is not limited to an electric resistive element, but may also comprise a conduit for guiding heated water such as engine cooling water. It is also possible to provide a heat source such as a resistive heater and warm water conduit in a remote part of the throttle body or external to the throttle body, and conduct the heat from the heat source to the required part of the throttle bore by using a heat conductor extending from the heat source to the required part.

Although the present invention has been described in terms of preferred embodiments thereof, it is obvious to a person skilled in the art that various alterations and modifications are possible without departing from the scope of the present invention which is set forth in the appended claims.

The contents of the original Japanese patent application on which the Paris Convention priority claim is made for the present application and the contents of any related prior art mentioned in the disclosure are incorporated in this application by reference.

The invention claimed is:

1. A throttle valve device for an internal combustion engine, comprising:

a throttle valve body defining a throttle bore extending substantially in a horizontal direction from an inlet on an upstream end of the throttle bore to an outlet on a downstream end of the throttle bore, the throttle bore extending along an axis that is substantially in the horizontal direction;

a throttle valve member comprising a butterfly valve rotatably supported by the throttle valve body for selectively opening and closing the throttle bore at an axially intermediate point of the throttle bore, the throttle valve having a default position defined by a small opening angle with respect to a fully closed position thereof;

an upstream recess formed in an inner wall of the throttle valve body and extending laterally, substantially in a lower part of the throttle bore, and extending axially for a prescribed distance in an upstream direction starting from a point upstream from a lower edge of the throttle valve member at the default position; and a downstream recess formed in an inner wall of the throttle valve body and extending laterally, substantially in a lower part of the throttle bore, and extending axially for a prescribed distance in a downstream direction starting from a point downstream from the lower edge of the throttle valve member at the default position wherein the throttle bore has a reference cross sectional area at a point corresponding to the lower edge of the throttle valve member at the default position, each recess enlarging the cross sectional area of the throttle bore in comparison to the reference cross sectional area, and a cross sectional area of one of the recesses over which the lower edge of the throttle valve member sweeps as the throttle valve member opens from the fully closed position is smaller than the cross sectional area of the other recess.

2. The throttle valve device for an internal combustion engine according to claim 1, wherein the throttle valve member is configured such that the lower edge of the throttle valve member moves in an upstream direction as the throttle valve member opens from the fully closed position, and the cross sectional area of the upstream recess is smaller than that of the downstream recess.

3. The throttle valve device for an internal combustion engine according to claim 1, wherein the throttle valve member is configured such that the lower edge of the throttle valve member moves in a downstream direction as the throttle valve member opens from the fully closed position, and the cross sectional area of the downstream recess is smaller than that of the upstream recess.

4. The throttle valve device for an internal combustion engine according to claim 1, wherein a ridge is defined between inner ends of the upstream and downstream recesses, the ridge having an upper surface defining a cylindrical throttle bore inner wall jointly with a remaining part of the cylinder bore.

5. The throttle valve device for an internal combustion engine according to claim 4, further comprising a heater incorporated in the ridge.

6. The throttle valve device for an internal combustion engine according to claim 1, wherein the throttle body is essentially made of plastic material.

7. The throttle valve device for an internal combustion engine according to claim 2, wherein an axially inner end of the downstream recess is located adjacent to the lower edge of the throttle valve member at the fully closed position thereof.

8. The throttle valve device for an internal combustion engine according to claim 4, wherein a surface area of a part of the upper surface of the ridge located downstream of the lower edge of the throttle member at the default position thereof is smaller than a surface area of a part of the upper surface of the ridge located upstream of the lower edge of the throttle member at the default position thereof.

9. The throttle valve device for an internal combustion engine according to claim 4, wherein a distance between the lower edge of the throttle member at the default position thereof and the inner end of the downstream recess is shorter than a distance between the lower edge of the throttle member at the default position thereof and the inner end of the upstream recess.

10. The throttle valve device for an internal combustion engine according to claim 1, wherein each recess is provided only in a lower part of the throttle bore.

11. The throttle valve device for an internal combustion engine according to claim 1, wherein each recess is defined by a bottom surface which is concentric to a remaining part of the throttle bore.

12. The throttle valve device for an internal combustion engine according to claim 1, wherein a downstream end of the throttle body is provided with a flange for connecting the throttle valve device to another intake member, and the downstream recess is formed in the flange.

13. The throttle valve device for an internal combustion engine according to claim 12, wherein the flange is provided with three mounting points including a top mounting point and a pair of lower mounting points arranged in a line symmetric arrangement with respect to a line passing through the top mounting point, and the downstream recess is formed only between the lower two mounting points.

14. The throttle valve device for an internal combustion engine according to claim 13, wherein the lower two mounting points are closer to each other than to the top mounting point.

* * * * *